US011799184B2

(12) United States Patent
Haroun et al.

(10) Patent No.: US 11,799,184 B2
(45) **Date of Patent: *Oct. 24, 2023**

(54) INTERPOSER BETWEEN AN INTEGRATED CIRCUIT ANTENNA INTERFACE AND AN EXTERNAL WAVEGUIDE INTERFACE INCLUDING AN INTERNAL WAVEGUIDE COUPLED BETWEEN THESE INTERFACES

(71) Applicant: Texas Instruments Incorporated, Dallas, TX (US)

(72) Inventors: Baher Haroun, Allen, TX (US); Juan Alejandro Herbsommer, Allen, TX (US); Gerd Schuppener, Allen, TX (US); Swaminathan Sankaran, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/140,858

(22) Filed: Jan. 4, 2021

(65) Prior Publication Data

US 2021/0151847 A1 May 20, 2021

Related U.S. Application Data

(63) Continuation of application No. 16/136,109, filed on Sep. 19, 2018, now Pat. No. 10,886,590.
(Continued)

(51) Int. Cl.
*H01P 5/08* (2006.01)
*H01P 11/00* (2006.01)
*H01P 3/16* (2006.01)

(52) U.S. Cl.
CPC ..... *H01P 5/087* (2013.01); *H01P 3/16* (2013.01); *H01P 11/001* (2013.01)

(58) Field of Classification Search
CPC ..... H01P 5/087; H01P 5/1022; H01P 3/16; H01P 5/12; H01P 5/107; H01Q 21/0037
(Continued)

(56) References Cited

U.S. PATENT DOCUMENTS 4,412,192 A * 10/1983 Paolino ..... H01P 1/067 333/261
5,528,074 A * 6/1996 Goto et al. ..... H01L 24/48 333/248
(Continued)

FOREIGN PATENT DOCUMENTS

CN 102272919 A 12/2011
CN 104064844 A 9/2014
(Continued)

OTHER PUBLICATIONS

Office Action for Chinese Patent Application No. 201880066453.0, dated Mar. 31, 2021, 8 pages.
(Continued)

*Primary Examiner* — Benny T Lee
(74) *Attorney, Agent, or Firm* — Frank D. Cimino

(57) ABSTRACT

An interposer acts as a buffer zone between a transceiver IC and a dielectric waveguide interconnect and establishes two well-defined reference planes that can be optimized independently. The interposer includes a block of material having: a first interface region to interface with an antenna coupled to an integrated circuit (IC); and a second interface region to interface to the dielectric waveguide. An interface waveguide is formed by a defined region positioned within the block of material between the first interface region and the second interface region.

25 Claims, 11 Drawing Sheets

Related U.S. Application Data

(60) Provisional application No. 62/570,853, filed on Oct. 11, 2017.

(58) Field of Classification Search
USPC ..... 333/248, 26
See application file for complete search history.

(56) References Cited

U.S. PATENT DOCUMENTS

| | | | | |
|---|---|---|---|---|
| 9,270,005 | B2 * | 2/2016 | Leiba et al. | H01P 3/003 |
| 9,300,025 | B2 | 3/2016 | Herbsommer et al. | |
| 10,371,891 | B2 | 8/2019 | Cook et al. | |
| 2011/0032685 | A1 | 2/2011 | Akiba et al. | |
| 2012/0013499 | A1 | 1/2012 | Hayata | |
| 2013/0154759 | A1 | 6/2013 | Morita et al. | |
| 2014/0240062 | A1 | 8/2014 | Herbsommer et al. | |
| 2015/0123867 | A1 * | 5/2015 | Legay et al. | H01Q 25/007 333/137 |
| 2015/0295305 | A1 | 10/2015 | Herbsommer et al. | |
| 2016/0064792 | A1 | 3/2016 | Qiang et al. | |
| 2016/0308266 | A1 | 10/2016 | Hammerschmidt | |
| 2017/0093011 | A1 | 3/2017 | Cook et al. | |
| 2017/0207510 | A1 | 7/2017 | Park et al. | |

FOREIGN PATENT DOCUMENTS

| | | | |
|---|---|---|---|
| EP | 0700114 | A2 | 3/1996 |
| EP | 2375444 | A1 | 10/2011 |
| KR | 20110102384 | A | 9/2011 |

OTHER PUBLICATIONS

EP Search Report for Application No. EP18866171, dated Oct. 26, 2020, 8 pages.

International Search Report for PCT/US2018/055167 dated Feb. 7, 2019, 2 pages.

"3D Printing", Wikipedia, available at http//en.wikipedia.org/w/index.php?title=3D_printing&oldid=624190184 on Sep. 4, 2014, pp. 1-35.

* cited by examiner

INTERPOSER BETWEEN AN INTEGRATED CIRCUIT ANTENNA INTERFACE AND AN EXTERNAL WAVEGUIDE INTERFACE INCLUDING AN INTERNAL WAVEGUIDE COUPLED BETWEEN THESE INTERFACES

CROSS-REFERENCE TO RELATED APPLICATIONS

This application is a continuation of U.S. patent application Ser. No. 16/136,109 filed Sep. 19, 2018 (issued as U.S. Pat. No. 10,886,590 on Jan. 5, 2021), which claims priority to U.S. Provisional Patent Application No. 62/570,853 filed Oct. 11, 2017, all of which are incorporated herein by reference.

TECHNICAL FIELD

This relates to an interposer between a microelectronic package substrate and a dielectric waveguide connector for mm-wave applications.

BACKGROUND

In electromagnetic and communications engineering, the term "waveguide" may refer to any linear structure that conveys electromagnetic waves between endpoints thereof. The original and most common meaning is a hollow metal pipe used to carry radio waves. This type of waveguide is used as a transmission line for such purposes as connecting microwave transmitters and receivers to their antennas, in equipment such as microwave ovens, radar sets, satellite communications, and microwave radio links.

A dielectric waveguide employs a solid dielectric core rather than a hollow pipe. A dielectric is an electrical insulator that can be polarized by an applied electric field. When a dielectric is placed in an electric field, electric charges do not flow through the material as they do in a conductor, but only slightly shift from their average equilibrium positions causing dielectric polarization. Because of dielectric polarization, positive charges are displaced toward the field and negative charges shift in the opposite direction. This creates an internal electric field which reduces the overall field within the dielectric itself. If a dielectric is composed of weakly bonded molecules, those molecules not only become polarized, but also reorient so that their symmetry axis aligns to the field. While the term "insulator" implies low electrical conduction, "dielectric" is typically used to describe materials with a high polarizability; which is expressed by a number called the "dielectric constant" ($\varepsilon k$). The term insulator is generally used to indicate electrical obstruction while the term "dielectric" is used to indicate the energy storing capacity of the material by means of polarization.

When waveguide dimensions are significantly larger than the wavelength of an electromagnetic wave, the electromagnetic waves in a metal-pipe waveguide may be imagined as travelling down the guide in a zig-zag path, being repeatedly reflected between opposite walls of the guide. For the particular case of a rectangular waveguide, it is possible to base an exact analysis on this view. Propagation in a dielectric waveguide may be viewed in the same way, with the waves confined to the dielectric by total internal reflection at the surface thereof. However, when the wavelength of the electromagnetic wave is closer to the dimension of the waveguide, then various electromagnetic transmission modes occur that are dependent on the waveguide dimensions.

SUMMARY

In described examples, an interposer that acts as a buffer zone between a transceiver IC and a dielectric waveguide interconnect is used to establish two well-defined reference planes that can be optimized independently. The interposer includes a block of material having: a first interface region to interface with an antenna coupled to an integrated circuit (IC); and a second interface region to interface to the dielectric waveguide. An interface waveguide is formed by a defined region positioned within the block of material between the first interface region and the second interface region.

DETAILED DESCRIPTION OF EXAMPLE EMBODIMENTS

Figure 1:
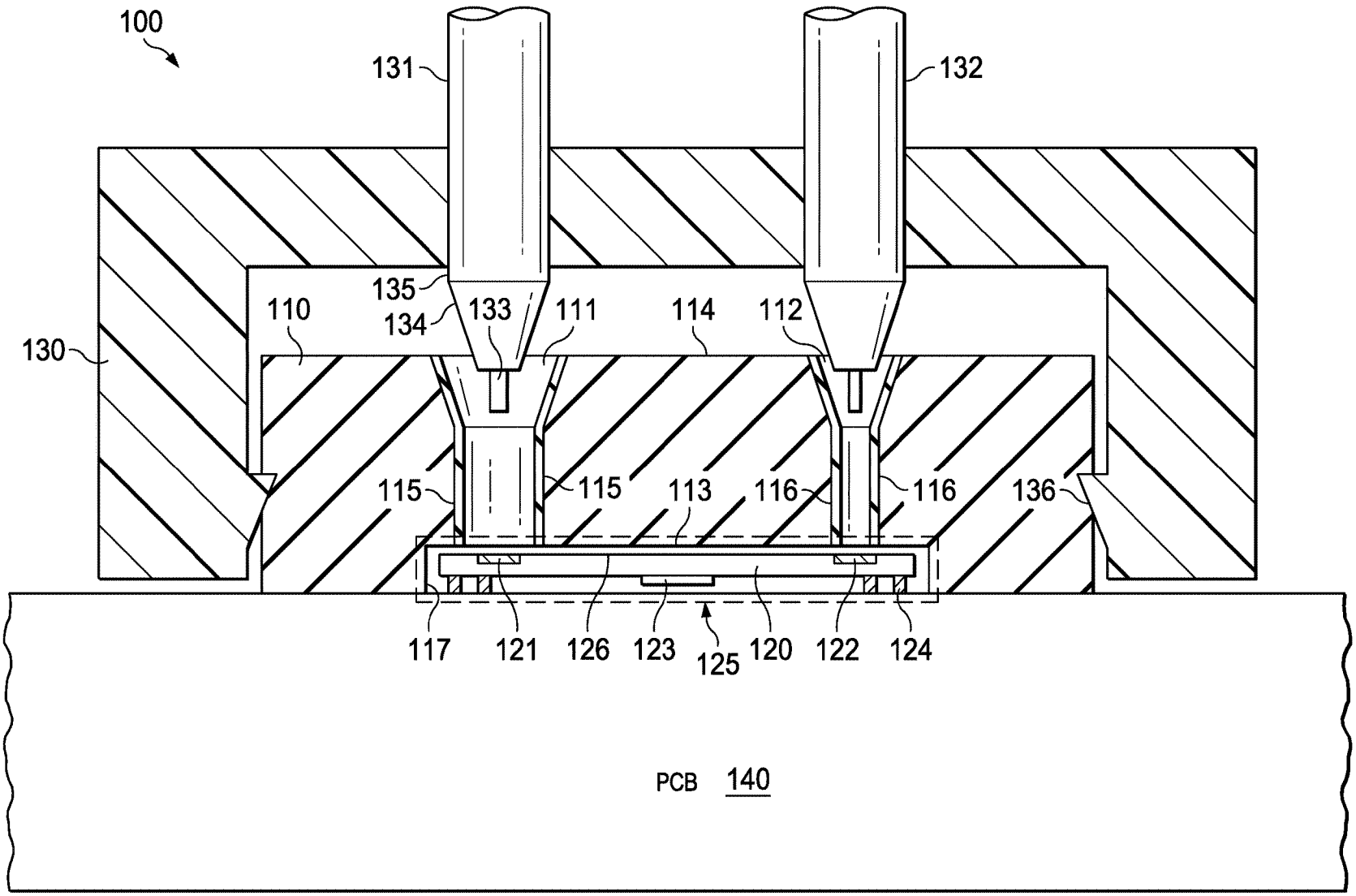
FIG. 1 is a cross-sectional view of a portion of an example system that includes an interposer located between radiating elements of a microelectronic device and a dielectric waveguide interconnect.

In the drawings, like elements are denoted by like reference numerals for consistency.

Waves in open space propagate in all directions as spherical waves. In this way, waves in open space they lose their power proportionally to the square of the distance; that is, at a distance R from the source, the power is the source power divided by $R^2$. A dielectric waveguide (DWG) may be used to transport high frequency signals over relatively long distances. The waveguide confines the wave to propagation in one dimension so that under ideal conditions the wave loses no power while propagating. Electromagnetic wave propagation along the axis of the waveguide is described by the wave equation, which is derived from Maxwell's equations, and where the wavelength depends upon the structure of the waveguide, and the material within it (air, plastic, vacuum, etc.), as well as on the frequency of the wave. A common type of waveguide is one that has a rectangular cross-section, one that is usually not square. It is common for the long side of this cross-section to be twice as long as its short side. These are useful for carrying electromagnetic waves that are horizontally or vertically polarized. Another common type of waveguide is circular. Circular waveguides are useful for carrying electromagnetic waves that are circularly polarized. Circular dielectric waveguides are easy to manufacture using known or later developed techniques.

Common problems that may occur when coupling a DWG to a radiating element include: a) poor isolation between a transmitter antenna and a receiver antenna located in the same microelectronic device; b) poor alignment between the radiating elements and the interconnect; and c) sub-optimal impedance matching between the antennas and the dielectric waveguide(s). The root cause is the lack of a well-defined electrical and mechanical interface between the radiating elements on a microelectronic device and the DWG interconnect.

Examples described hereinbelow improve the interface between electromagnetic radiation elements on a microelectronic device and a DWG interconnect. An interposer that acts a buffer zone is used to establish two well-defined reference planes that can be optimized independently. A first plane is located between the radiating elements and the interposer and a second plane is a surface between the interposer and the DWG interconnect. The interposer allows for the introduction of features that improve the isolation between transmitter and receiver antennas in the device, relax the alignment tolerances, and enhance the impedance matching between the antennas and the dielectric waveguide. As will be described in more detail hereinbelow, the interposer is a block of material that interfaces the antennas in a substrate with a DWG connector. The interposer has defined regions that align with the antennas and act as waveguides to conduct a signal from a radiating element on a microelectronic device substrate to a DWG connector.

FIG. 1 is a cross-sectional view of a portion of an example system 100 that includes an interposer 110 located between antennas 121, 122 of a microelectronic device 125 and a dielectric waveguide interconnect 130. In this example, antenna 121 is a transmitting antenna and antenna 122 is a receiving antenna. However, in other examples, there may be two or more transmitting antennas, two or more receiving antennas, or various combinations.

In this example, antennas 121, 122 are dipole antennas sized to launch or receive radio frequency (RF) signals having a frequency in the range of approximately 110-140 GHz. However, in other examples higher or lower frequencies may be used by sizing antennas 121, 122 appropriately. As used herein, the term "antenna" refers to any type of radiating element or launch structure that is useful for launching or receiving high frequency RF signals. U.S. Pat. No. 9,300,025 is incorporated by reference herein and describes several example antenna configurations, including dipoles as well as other types of launch structures.

A ball grid array (BGA) is a well-known type of surface-mount packaging, also referred to as a chip carrier, used for integrated circuits (IC). A BGA can provide more interconnection pins than can be put on a dual in-line or flat package. The whole bottom surface of the device may be used, instead of just the perimeter. The leads are also on average shorter than with a perimeter-only type, leading to better performance at high speeds. In this example, BGA substrate 120 provides a substrate onto which IC die 123 is mounted in a "dead bug" upside down manner. Antennas 121 and 122 are fabricated on the top side of BGA substrate 120 by patterning a copper layer using known or later developed fabrication techniques. In this example, IC die 123 includes a transmitter and a receiver that are coupled to respective transmitter antenna 121 and receiver antenna 122 by differential signal paths that are fabricated on BGA substrate 120. Solder balls 124 are used to connect signal and power pads on BGA substrate 120 to corresponding pads on substrate 140 using a known or later developed solder process.

BGA substrate 120 and IC die 123 together may be referred to as "BGA package," "IC package," "integrated circuit," "IC," "chip," "microelectronic device," or similar terminology. BGA package 125 may include encapsulation material to cover and protect IC die 123 from damage.

While IC die 123 is mounted in a dead bug manner in this example, in other examples an IC containing RF transmitters and/or receivers may be mounted on the top side of BGA substrate 120 with appropriate modification to interposer 110 to allow for mechanical clearance. In this example, IC die 123 is wire bonded to BGA substrate 120 using known or later developed fabrication techniques. In other examples, various known or later developed packaging configurations, such as QFN (quad flat no lead), DFN (dual flat no lead), MLF (micro lead frame), SON (small outline no lead), flip chips, dual inline packages (DIP), etc., may be attached to a substrate and coupled to one or more antennas thereon.

Substrate 140 may have additional circuit devices mounted on it and interconnected with BGA package 125. Substrate 140 may be single sided (one copper layer), double sided (two copper layers), or multi-layer (outer and inner layers). Conductors on different layers may be connected with vias. In this example, substrate 140 is a printed circuit board (PCB) that has multiple conductive layers of that are patterned using known or later developed PCB fabrication techniques to provide interconnect signal lines for various components and devices that are mounted on substrate 140. Glass epoxy is a primary insulating substrate; however various examples may use various types of known or later developed PCBs. In other examples, substrate 140 may be fabricated using various known or later developed techniques, such as from ceramic, a silicon wafer, plastic, etc.

Interposer 110 is a block of material that is shaped to provide a well-defined reference plane 113 that is positioned adjacent a top surface 126 of BGA substrate 120. A second well-defined reference plane 114 is positioned adjacent DWG interconnect 130. In this example, interposer 110 includes two defined regions 111, 112 that form interface waveguides between reference plane 113 and reference plane 114. In this example, waveguide regions 111, 112 are open and therefore filled with air, or other ambient gas or liquid. In this example, interface waveguide regions 111, 112 are lined with a conductive layer 115, 116 such that interface waveguide regions 111, 112 act as metallic waveguides. In another example, waveguide regions 111, 112 may be filled with a dielectric material to act as dielectric waveguides. In this example, interposer 110 is fabricated from an electrically non-conductive material, such as plastic, epoxy, ceramic, etc.

In another example, a portion of the interposer 110 between the antennas 121, 122 and/or a portion of substrate 140 between antennas 121, 122 may be defined using a photonic bandgap (PBG) structure. Fabrication of PBG structures are described in more detail in U.S. Pat. Ser. No. 10,371,891, which is incorporated by reference herein. The purpose of the PBG is to create a high impedance path that avoids or diminishes the wave propagation between two points (or areas). In this particular application it is desirable to reduce the cross-talk and increase isolation between the transmitter antenna 121 and receiver antenna 122. A portion of the interposer material may include a matrix of interstitial nodes that may be filled with a material that is different from the bulk interposer material. The nodes may be arranged in a three-dimensional array of spherical spaces that are in turn separated by a lattice of interposer material. The photonic bandgap structure formed by periodic nodes may effectively guide an electromagnetic signal through the PBG waveguide.

Interface waveguides 111, 112 may have a rectangular cross-section, for example. The long side of this cross-section may be twice as long as its short side, for example. This is useful for carrying electromagnetic waves that are horizontally or vertically polarized. For sub-terahertz signals, such as in the range of 130-150 gigahertz, a waveguide dimension of approximately 1.5 mm×3.0 mm works well. In another example, interface waveguides 111, 112 may have a circular cross-section for carrying electromagnetic waves that are circularly polarized.

Interposer 110 includes a cavity 117 that is designed to allow the interposer to rest solidly on substrate 140 while leaving a small gap between the top surface 126 of BGA package 125 and surface 113 of interposer 110. In this manner, BGA package 125 is isolated from stress or movement of interposer 110 that might affect the connection reliability of solder balls 124.

DWG interconnect 130 is shaped to couple to interposer 110 in order to align one or more DWG, such as DWG 131, 132, with waveguide regions 111, 112. Each DWG 131, 132 includes a core 133 and a cladding 134. In this example, each DWG 131, 132 also is covered by an external shield material 135 to provide protection from abrasion.

At reference plane 113, waveguide regions 111, 112 are sized to approximately match the characteristic impedance of antennas 121, 122 in order to provide a good coupling efficiency. At reference plane 114, waveguide regions 111, 112 flare out to provide a transition to DWG 131, 132 in order provide a good coupling efficiency to DWG 131, 132.

A signal may be launched into waveguide 111 by transmitter antenna 121 that is generated by a transmitter circuit in IC die 123 using known or later developed techniques. Interface waveguide 111 may then conduct the signal to reference plane 114 on the other side of interposer 110 with minimal radiation loss. In this manner, insertion loss between a transmitter on IC 123 and DWG 131 may be held to an acceptable level. For example, if a communication link has a total insertion loss budget of 22 dB, maintaining the insertion loss from the transmitter within IC 123 to DWG 131 to less than 3 dB is desirable. Similarly, maintaining the insertion loss from the DWG 132 to the receiver within IC 123 to less than 3 dB is desirable. Even if a system has a higher loss budget than 22 dB, it may be desirable that insertion losses of the transitions should not exceed a modest percentage of the loss budget, such as ten percent.

DWG interface 130 may include an interlocking mechanism that may interlock with interposer 110 to thereby hold DWG interface 130 securely in place. In this example, DWG interface 130 includes a socket configuration that mates with interposer 110. The interlocking mechanism may be a simple friction scheme, a ridge or lip that interlocks with a depression on interposer 110, or a more complicated known or later developed interlock scheme. In this example, barbs 136 protrude from DWG interface 130 to mechanically interact with interposer 110. In other examples, DWG interface 130 may have a different configuration. For example, DWG interface 130 may be screwed onto substrate 140 or interposer 110, may snap onto interposer 110, may be soldered down to the PCB 140, etc.

Figure 2:
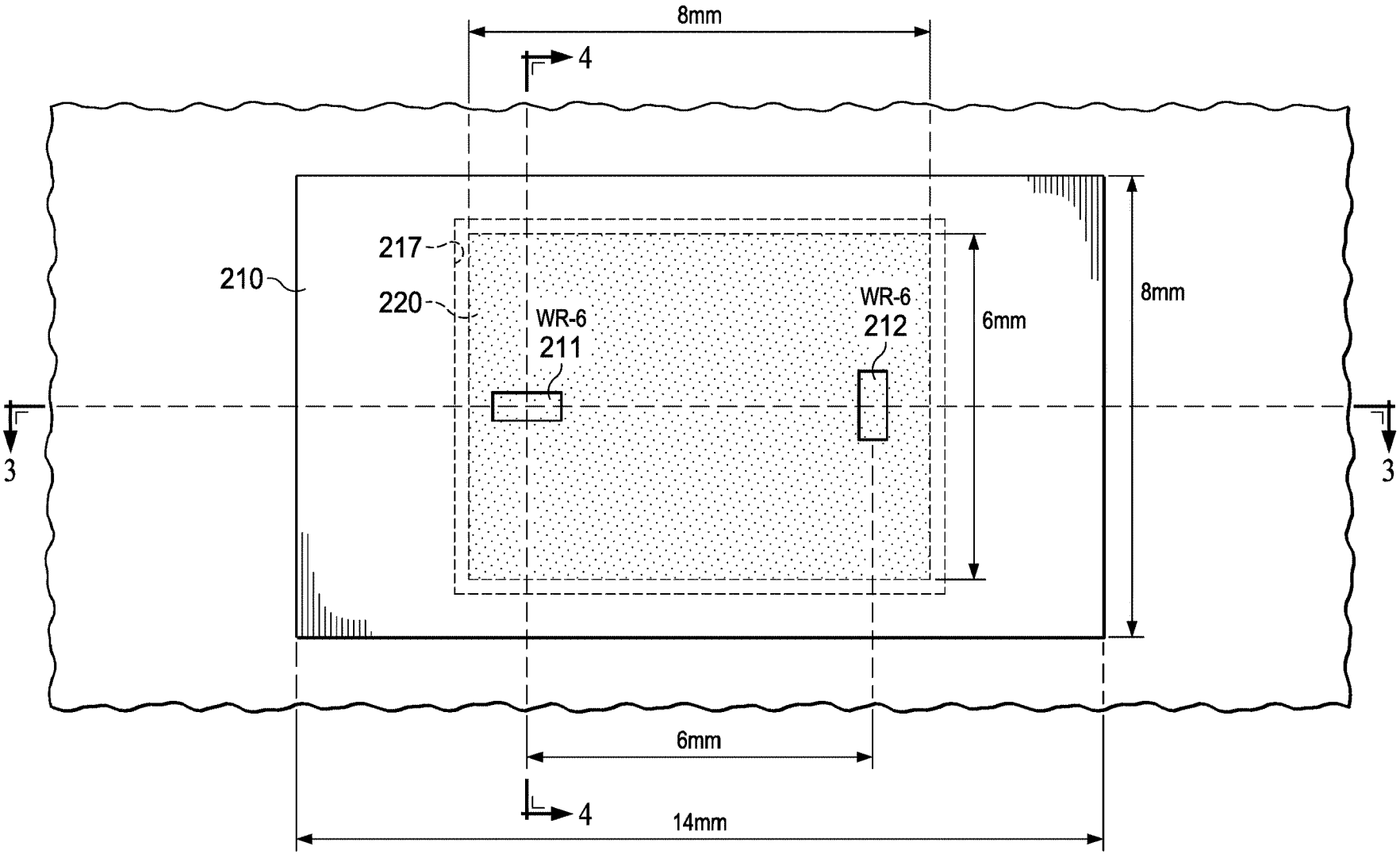
FIGS. 2-4 are top, front and side views of another example interposer.
Figure 3:
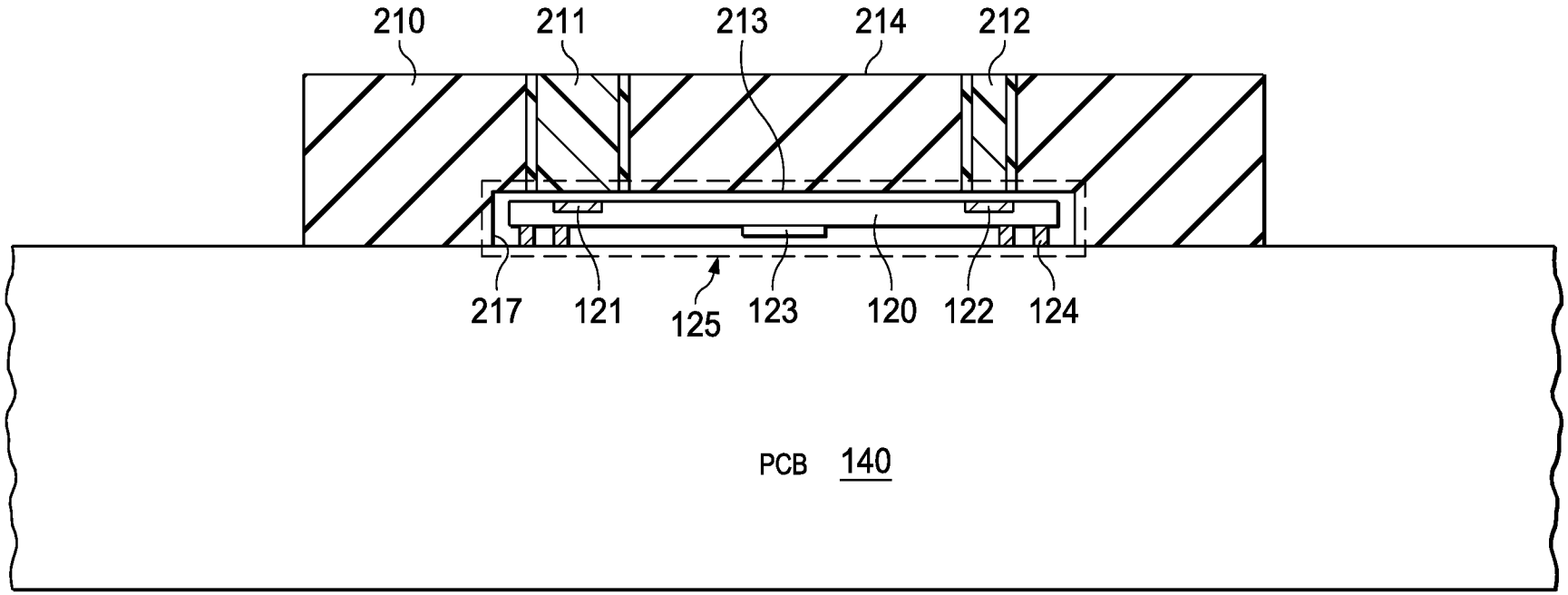
Figure 4:
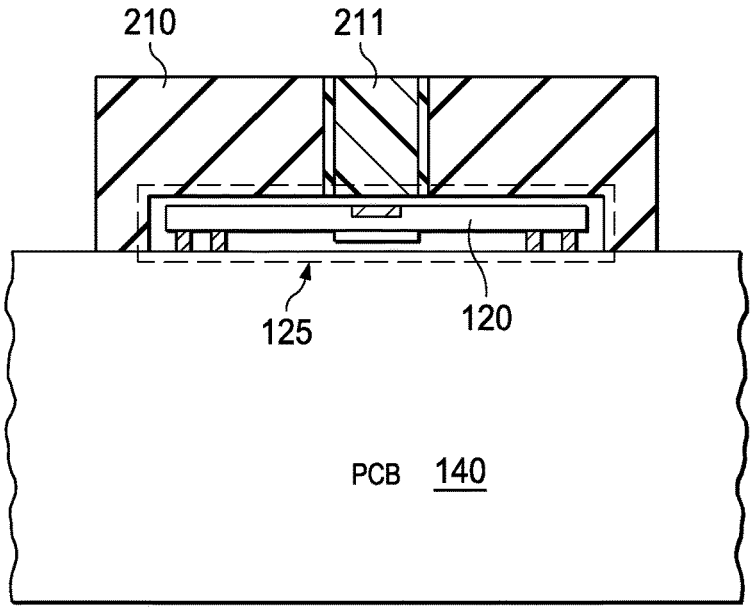

FIGS. 2-4 are top, front, and side views, respectively, of an example interposer 210, which is similar to interposer 110 (FIG. 1). However, in this example, interface waveguide regions 211, 212 (FIGS. 2 and 3) are straight rather than tapered at top reference plane 214 (FIG. 3). As mentioned hereinabove, in another example interface waveguide regions may have a circular cross section. In this example, interposer 210 has a rectangular shape, approximately 8 mm×14 mm. In this example, waveguide regions 211, 212 are approximately 6 mm center to center to align with antennas 121, 122 (FIG. 3) on BGA package 125 (FIGS. 3 and 4).

For an interposer to provide a standardized interface, it may be useful to define a set of waveguide dimensions that are appropriate for various frequencies. For example, various sizes of waveguides have been standardized by the Electronic Industries Alliance (EIA) RS-261-B, "Rectangular Waveguides (WR3 to WR2300)" to promote interchangeability of metallic waveguides. WR-6 (rectangular waveguide as shown in FIG. 2) is a standard dimension (approximately 0.83×1.7 mm) for a band of operation of approximately 110-170 GHz. WR-5 is a standard dimension (approximately 0.65×1.3 mm) for 140-220 GHz. In this example, waveguide regions 211, 212 have a rectangular cross section and are sized to the WR-6 standard for operation in the 110-170 GHz band. Other example interposers may include waveguide regions with larger or smaller standard sizes for systems operating in different frequency bands. Table 1 lists EIA standardized rectangular waveguide sizes for operation across a range of frequencies of 18-500 GHz. While Table 1 is intended for metallic waveguides, a standardized interposer interface may be provided based on these dimensions. Alternatively, a different set of dimensions may be adopted that may be more appropriate for dielectric waveguides.

TABLE 1

Rectangular Waveguide Specifications

| Frequency GHz | EIA Waveguide | Frequency Band | TE-10 Mode Cutoff, GHz | Inside Waveguide Dimensions inches (mm) |
|---|---|---|---|---|
| 18-26.5 | WR-42 | K | 14.08 | 0.420 × 0.170 (10.7 × 4.3) |
| 26.5-40 | WR-28 | Ka | 21.1 | 0.280 × 0.140 (7.11 × 3.56) |
| 33-50 | WR-22 | Q | 26.35 | 0.224 × 0.112 (5.7 × 2.8) |
| 40-60 | WR-19 | U | 31.41 | 0.188 × 0.094 (4.8 × 2.4) |
| 50-75 | WR-15 | V | 39.9 | 0.148 × 0.074 (3.8 × 1.9) |
| 60-90 | WR-12 | E | 48.4 | 0.122 × 0.061 (3.1 × 1.5) |
| 75-110 | WR-10 | W | 59.05 | 0.100 × 0.050 (2.54 × 1.27) |
| 90-140 | WR-08 | F | 73.84 | 0.08 × 0.040 (2.32 × 1.02) |
| 110-170 | WR-06 | D | 90.85 | 0.065 × 0.0325 (1.7 × 0.83) |
| 140-220 | WR-05 | G | 115.75 | 0.051 × 0.0255 (1.30 × 0.648) |
| 170-260 | WR-04 | — | 137.52 | 0.043 × 0.0215 (1.1 × 0.55) |
| 220-325 | WR-03 | — | 173.28 | 0.034 × 0.017 (0.86 × 0.43) |
| 325-400 | WR-2.8 | — | 211 | 0.028 × 0.014 (0.71 × 0.355) |
| 400-500 | WR-2.2 | — | 268 | 0.022 × 0.011 (0.56 × 0.28) |

In this example, cavity 217 (FIGS. 2 and 3) is sized to fit over BGA package 125 (FIGS. 3 and 4) that is approximately 8 mm×6 mm. The extent of package 125 is indicated by outline 220 (FIG. 2). Cavity 217 encloses BGA package 125 and thereby aligns waveguide regions 211, 212 included within interposer 210 with antennas 121, 122 has shown in FIG. 3) located on BGA substrate 120 (FIGS. 3 and 4). Lower reference plane 213 (FIG. 3) forms the top of cavity 217 and is positioned to be spaced apart from the top surface of BGA package 125.

Interface waveguide regions 211, 212 are oriented such that the rectangular cross section of waveguide 212 is perpendicular to the rectangular cross section of waveguide region 211. In this manner, cross coupling between waveguides may be reduced. Cross coupling may be less of an issue if antennas 211, 212 are both transmitting or both receiving.

Figure 5:
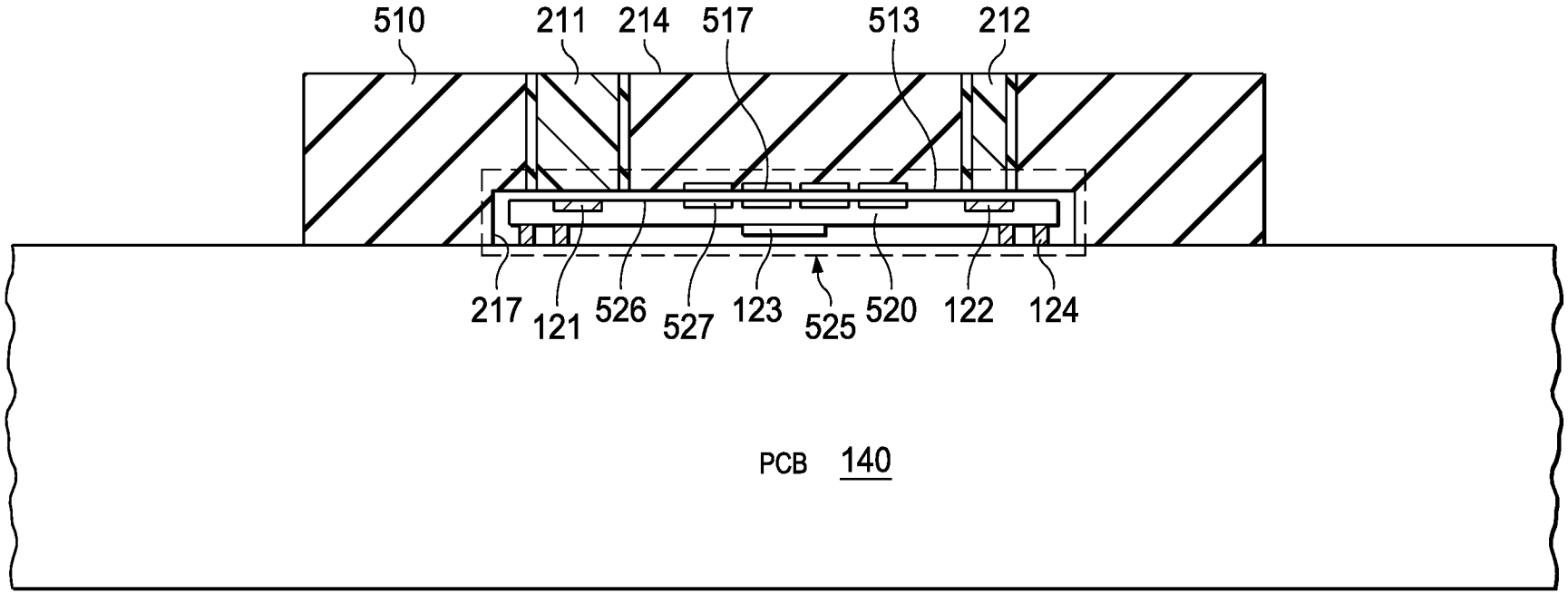
FIGS. 5-7 are cross sectional views of other example interposer configurations.

FIG. 5 is a cross sectional view of another example interposer configuration. Note that the space between the reference plane 513 and the top surface of BGA package 525 may act as a waveguide and allow radiation emitted by transmitter antenna 121 to propagate to receiver antenna 122 and thereby cause interference. In this example, an electronic bandgap (EBG) structure 517 is fabricated on the surface of reference plane 513 of interposer 510. Alternatively, an electronic bandgap structure 527 may be formed on surface 526 of BGA substrate 520. In some examples, an EBG structure 517 may be formed on the surface of reference plane 513 and an EBG structure 527 may also be formed on surface 526 of BGA package 525. EBG structure 517 and/or EBG structure 527 creates a high impedance path for the electromagnetic wave and in this way inhibits the propagation of the signal from transmitter antenna 121 to receiver antenna 122. In this manner, cross talk between antenna 121 and antenna 122 may be minimized. Similarly, if both antennas 121, 122 are transmitting, interference may be minimized.

An EBG structure may be fabricated using a periodic arrangement of dielectric or magnetic materials using known or later developed techniques that form a stop band in the frequency region being transmitted by transmitter antenna 121.

Figure 6:
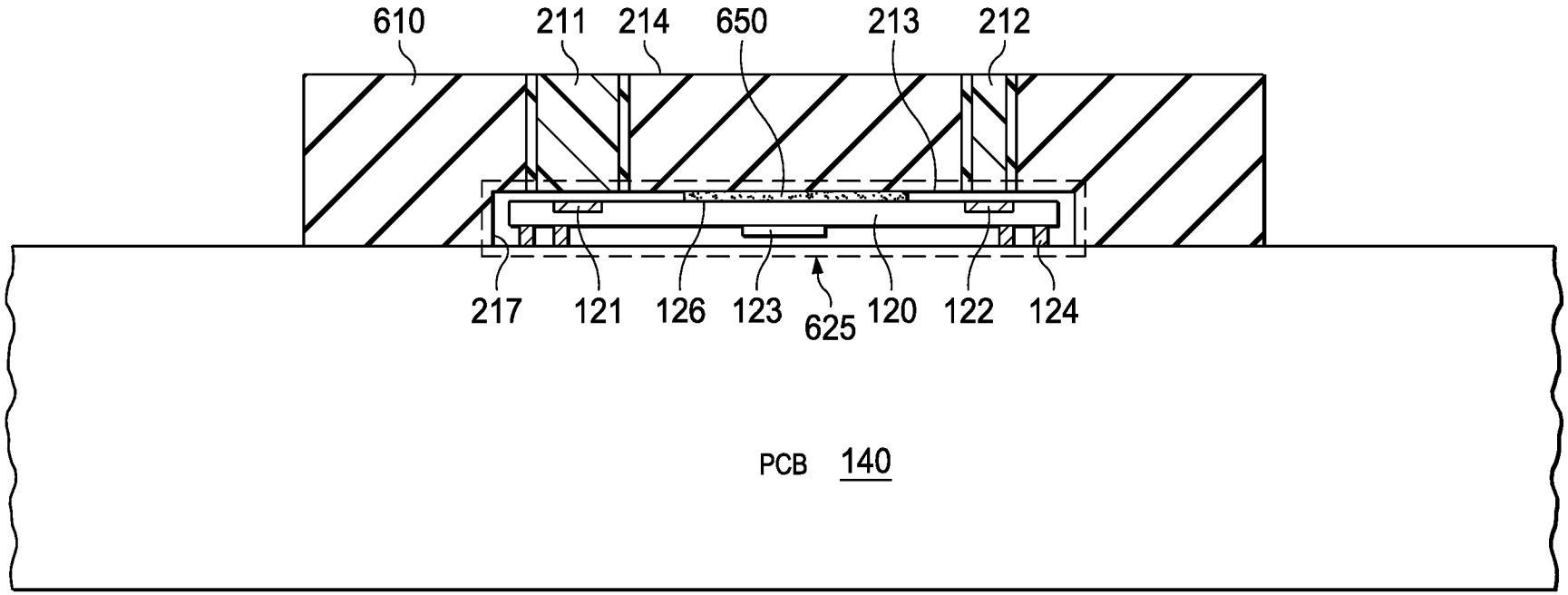

FIG. 6 is a cross sectional view of another example interposer configuration. Note that the space between the reference plane 213 of interposer 610 and the top surface of BGA package 625 may act as a waveguide and allow radiation emitted by transmitter antenna 121 to propagate to receiver antenna 122 and thereby cause interference. In this example, a compliant material 650 is placed between interposer 610 and BGA package 625. Compliant material 650 may be formulated to be absorptive to RF radiation that is being emitted from transmitter antenna 121. In this manner, cross talk between antenna 121 and antenna 122 may be minimized. In another example, compliant material 650 may be formulated to be reflective to RF radiation that is being emitted from transmitter antenna 121. In this manner, cross talk between antenna 121 and antenna 122 may be minimized. Similarly, if both antennas 121, 122 are transmitting, interference may be minimized.

Figure 7:
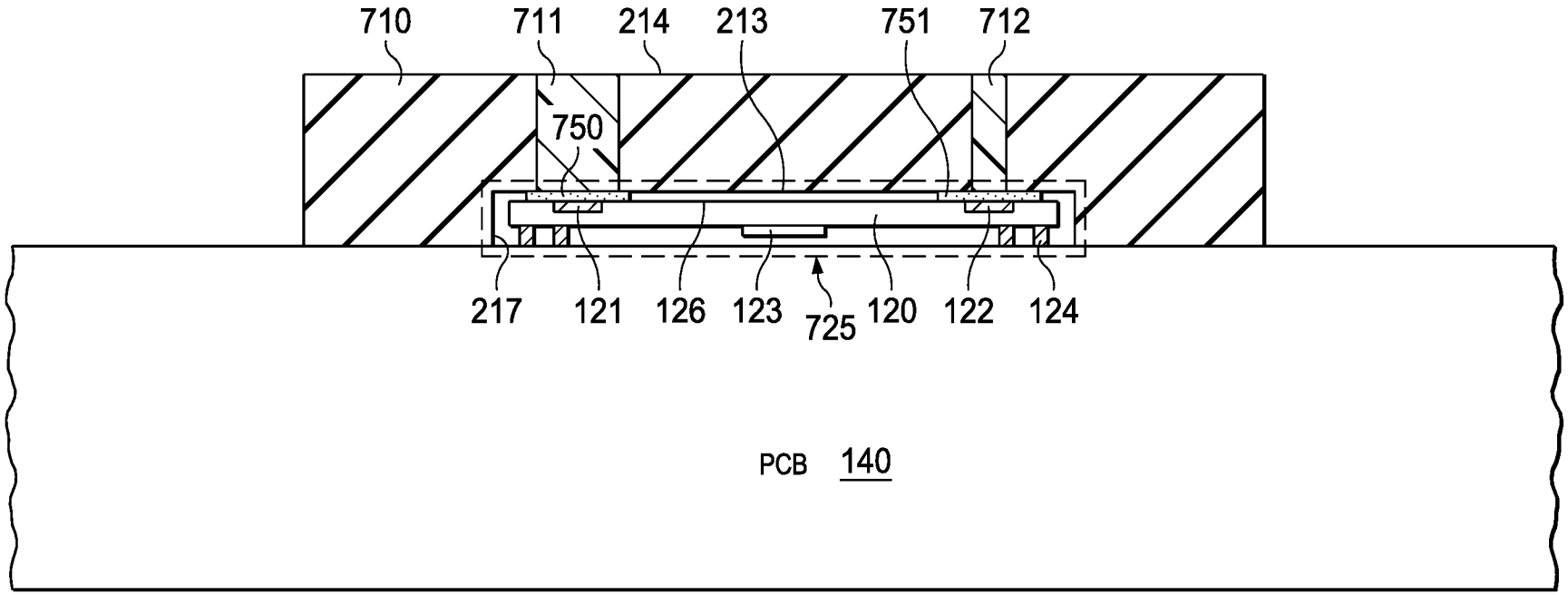

FIG. 7 is a cross sectional view of another example interposer configuration. In this example, the interface waveguides 711, 712 are filled with a dielectric material and the interface waveguides 711, 712 therefore act as dielectric waveguides. Since there is a small gap between the top of antennas 121, 122 and reference plane 213, reflections may occur due to the difference in materials in the path of the electromagnetic field. In this example, a deformable material 750, 751 that has approximately a same dielectric constant as the dielectric material in interface waveguides 711, 712 is placed between the BGA package 725 and interposer 710. In this manner, reflections are minimized at the antenna interfaces.

Figure 9:
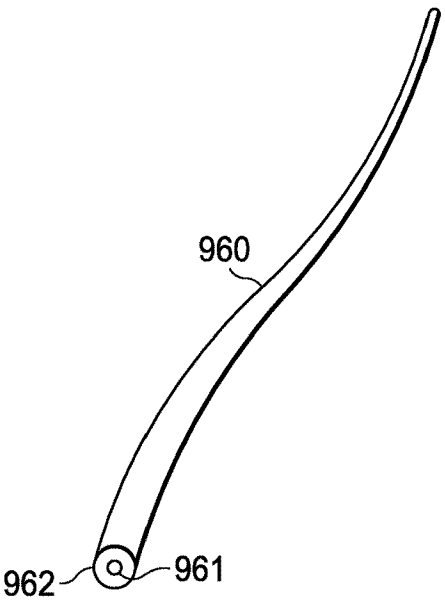
FIGS. 8A, 8B and 9 are cross sections of various configurations of dielectric waveguides.
Figure 8B:
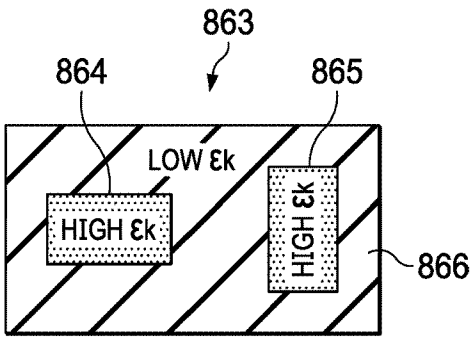
Figure 8A:
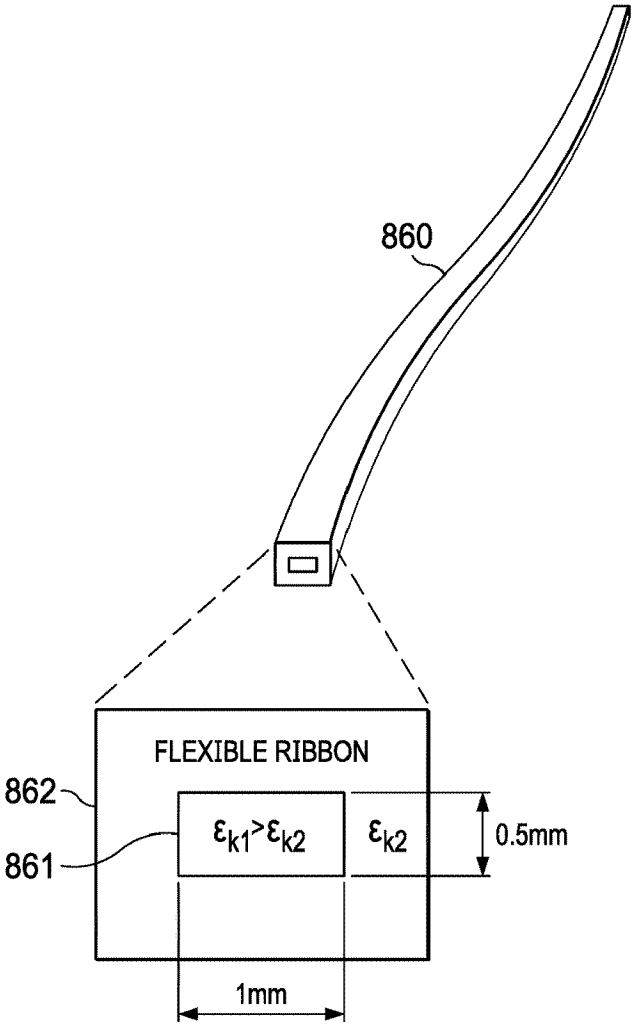

FIGS. 8A-8B, 9 are cross sections of various configurations of dielectric waveguides. As discussed above, for point to point communications using modulated radio frequency techniques, dielectric waveguides provide a low-loss method for directing energy from a transmitter (TX) to a receiver (RX). Many configurations are possible for waveguide 860 (FIG. 8A). A solid DWG may be produced using printed circuit board technology, for example. Generally, a solid DWG is useful for short interconnects or longer interconnects in a stationary system. PCB manufacturers can create board materials with different dielectric constants by using micro-fillers as dopants, for example. A dielectric waveguide may be fabricated by routing a channel in a low dielectric constant (εk2) board material and filling the channel with high dielectric constant (εk1) material, for example. However, their rigidity may limit their use where the interconnected components may need to be moved relative to each other.

In FIG. 8A, a flexible waveguide 860 configuration may have a core member made from flexible dielectric material (e.g., a flexible ribbon) with a high dielectric constant (εk1) and be surrounded with a cladding made from flexible dielectric material with a low dielectric constant, (εk2). Theoretically, air could be used in place of the cladding; however, since air has a dielectric constant of approximately 1.0, any contact by humans, or other objects, may introduce serious impedance mismatch effects that may result in signal loss or corruption. Therefore, typically free air does not provide a suitable cladding.

In this example, a thin rectangular ribbon of the core material 861 is surrounded by a cladding material 862 to form DWG 860. Referring to DWG 131, 132 (FIG. 1), DWG 860 may also include another layer of protective coating material, such as layer 135 (FIG. 1). For linearly polarized sub-terahertz signals, such as in the range of 130-150 gigahertz, a rectangular core dimension of approximately 0.5 mm×1.0 mm works well. DWG 860 may be manufactured using known extrusion techniques, for example.

FIG. 8B is a cross sectional view of another example DWG 863, which may be fabricated in a similar manner as DWG 860 (FIG. 8A). In this example, two cores 864, 865 made from a flexible dielectric material having a high dielectric constant (HIGH εk) are surrounded by a common cladding material 866 made from a flexible dielectric material with a low dielectric constant (LOW εk). Note that core 865 is placed at a right angle to core 864 to reduce cross talk. DWG 863 may be used in place of DWGs 131, 132 in FIG. 1, for example.

In other examples, multiple cores may be bundled together in a common cladding to provide high bandwidth signal propagation and to simplify system assembly, for example. For example, a ribbon cable with multiple DWG cores may be formed. However, such a configuration is not always desired. As the number of DWG "channels" increases, the width of the ribbon tends to increase which may not be desirable for some applications. In addition, the waveguides themselves in a ribbon configuration are configured in an arrangement where crosstalk between adjacent waveguide channels may be intrusive, since all waveguides are essentially in the same plane. To alleviate the potential crosstalk problem, the channel spacing may be increased or shielding may need to be added.

For the exceedingly small wavelengths encountered for sub-THz radio frequency signals, dielectric waveguides perform well and are much less expensive to fabricate than hollow metal waveguides. Furthermore, a metallic waveguide has a frequency cutoff determined by the size of the waveguide. Below the cutoff frequency there is no propagation of the electromagnetic field. Dielectric waveguides have a wider range of operation without a fixed cutoff point.

FIG. 9 is a cross sectional view of another example DWG 960. In this example, a thin circular ribbon of the core material 961 is surrounded by a cladding material 962 to form DWG 960. For circularly polarized sub-terahertz signals, such as in the range of 130-150 gigahertz, a circular core dimension of approximately 1-2 mm diameter works well. For a given application, the circular core dimension may be selected to optimize attenuation, dispersion, and isolation requirements.

A circularly polarized RF signal may be launched using a quad-pole antenna, in which each pole is orthogonal to its neighbor poles. Phase delay can be applied to the signals connected to each pole to launch a circularly polarized RF signal. Other known or later developed antenna structures may be used to launch and/or receive circularly polarized RF signals.

Figure 10:
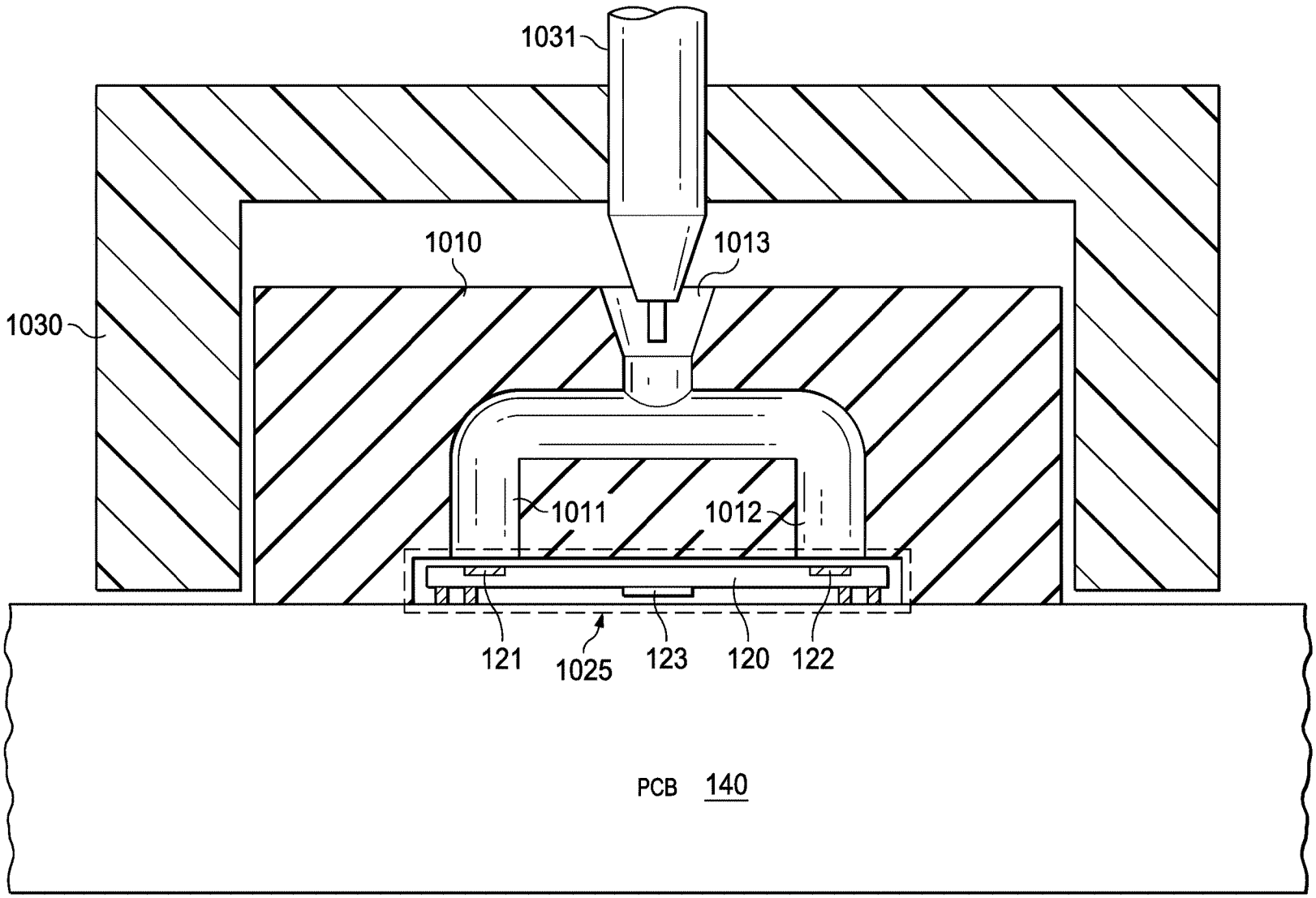
FIG. 10 is a side view of another example interposer.

FIG. 10 is a side view of another example interposer 1010. DWG interconnect 1030 is shaped to couple to interposer 1010 in order to align DWG 1031 with waveguide region 1013, in a similar manner to DWG interconnect 130 (FIG. 1). In this example, an interface waveguide region 1011 that is positioned to interface with antenna 121 of BGA package 1025 and an interface waveguide region 1012 that is positioned to interface with antenna 122 of BGA package 1025 merge together to form a single waveguide region 1013 to interface with a single DWG 1031. In this manner, bidirectional multiplexed communication may be performed using a single DWG 1031. Known or later developed techniques may be used for bidirectional communications. For example, frequency multiplexing in which different frequencies are used for transmitting and receiving may be used in a continuous manner. Alternatively, time multiplexing may be used in which transmission is performed for a period of time and then reception is performed for a period of time, etc.

Interposer 1010 may be fabricated by various known or later developed techniques, such as injection molding, 3D additive manufacturing processes, etc.

Figure 11:
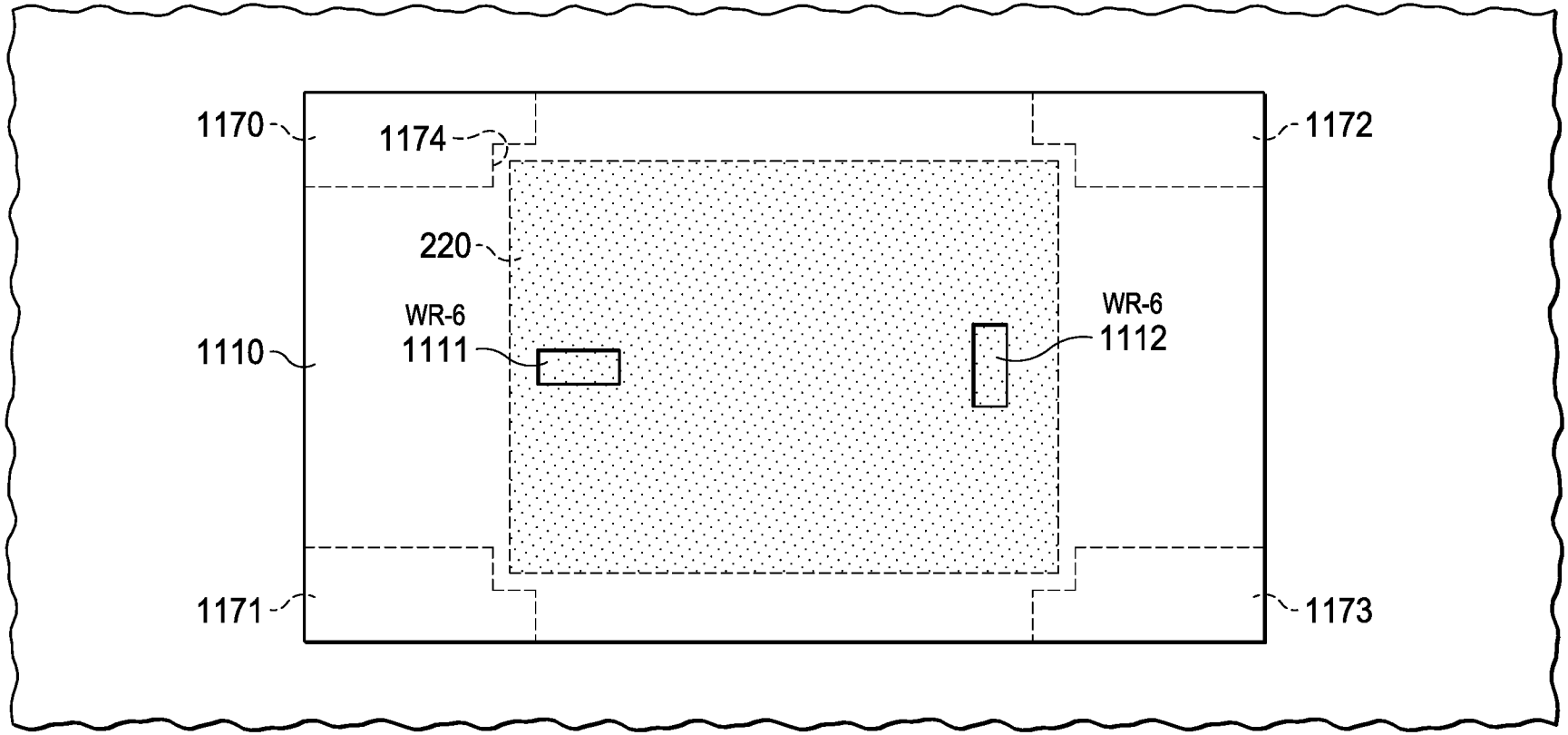
FIG. 11 is a top view of another example interposer.

FIG. 11 is a top view of another example interposer 1110. In this example, interface waveguide regions 1111, 1112 are similar to interface waveguide regions 211, 212 (FIG. 2). In this example, rather than having a cavity, such as cavity 217 (FIG. 2), standoffs 1170, 1171, 1172 and 1173 provide support for mounting interposer 1110 on a PCB substrate, such as PCB 140 (FIG. 1). Index notches, such as notch 1174, are provided to assist with aligning interposer 1110 over BGA substrate 220 so that the antennas on BGA substrate 220 align with waveguide regions 1110, 1111.

Figure 12:
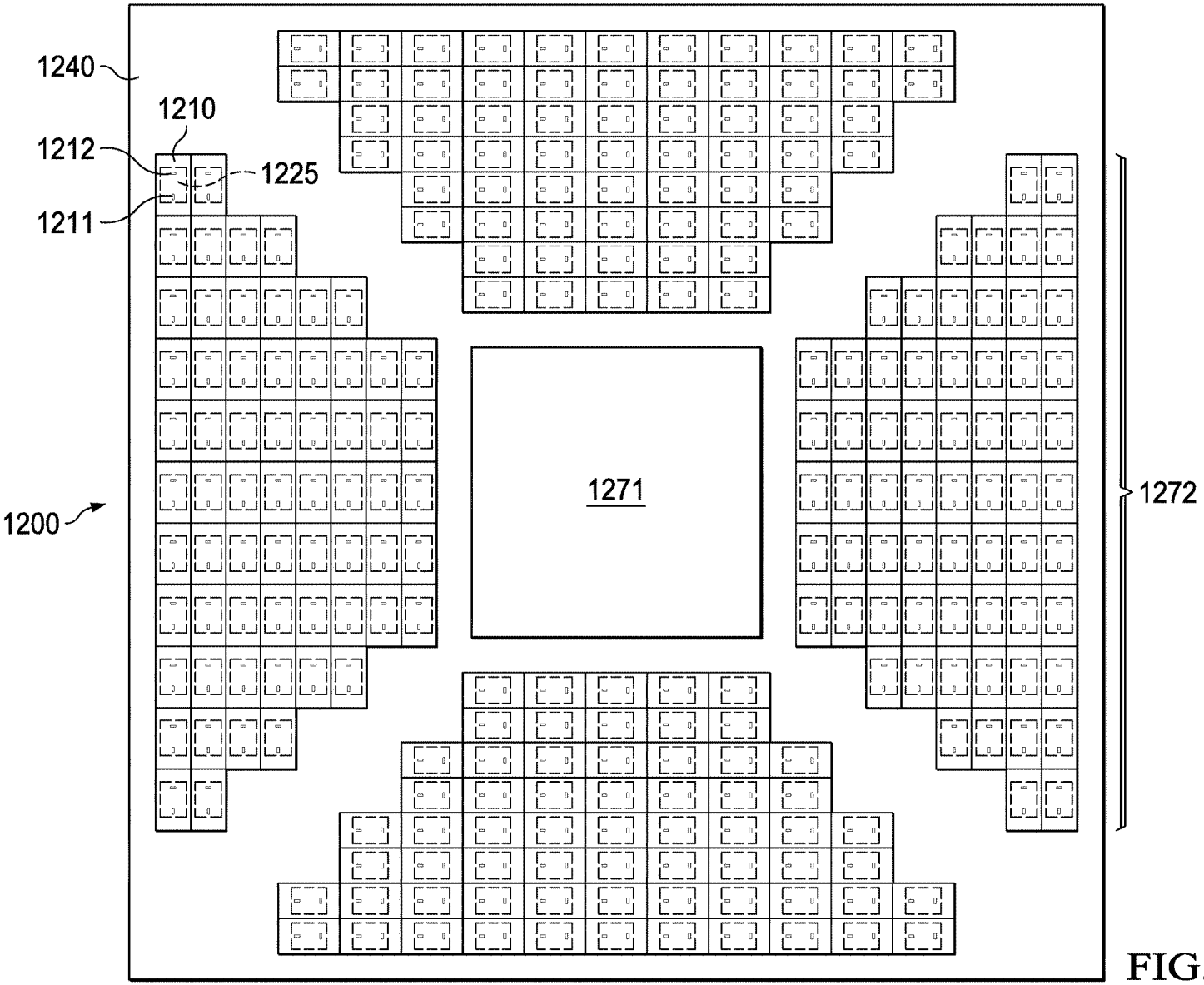
FIG. 12 is a top view of an example system that includes 256 microelectronic devices with interposers for each device.

FIG. 12 is a top view of an example system 1200 that includes 256 transmitter/receiver (transceiver) microelectronic devices with interposers for each device. Each transceiver device, such as BGA package 1225, has an interposer, such as interposer 1210, placed over it. Interface waveguide regions 1211, 1212 align with transmitting and/or receiving antennas on BGA package 1225, as described in more detail hereinabove.

All 256 transceiver devices (also referred to as ICs) such as BGA package 1225, are mounted PCB 1240. In this example, a system on chip (SOC) 1271 is interconnected to all 256 transceiver ICs and functions as a router to send and receive massive amounts of data via the 256 transceiver ICs.

DWGs, such as DWGs 131, 132 (FIG. 1) may be interfaced to each interposer and thereby to each transceiver IC, as described in more detail hereinabove.

In this example, each interposer is fabricated to cover a single transceiver IC. In another examples, multiple interposers may be fabricated as a single unit to cover multiple transceiver ICs. For example, an entire quadrant of 64 transceiver ICs, such as quadrant 1272, may be covered with a single interposer.

Figure 13:
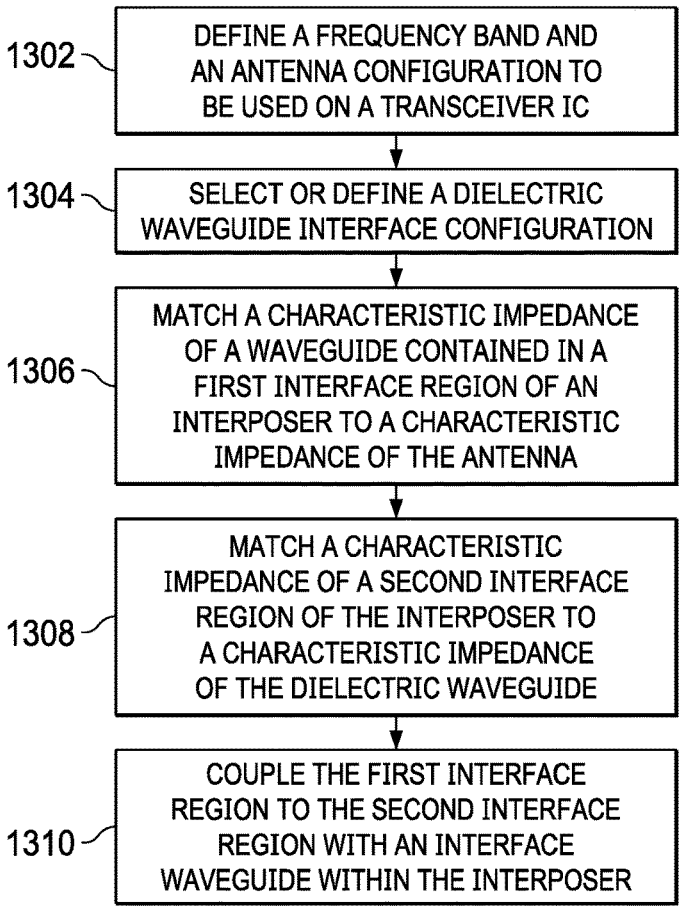
FIG. 13 is a flow diagram of use of an interposer.

FIG. 13 is a flow diagram of a method of interfacing a dielectric waveguide to an antenna on an integrated circuit using in interposer.

At 1302, a frequency band and an antenna configuration are selected or defined to be used on a transceiver IC. For example, it may be decided that a transceiver IC will operate in the 120-140 GHz band of RF. A dipole antenna configuration may be selected for a transmit antenna and a receive antenna. The antennas may be designed to have a characteristic impedance using known or later developed antenna design techniques.

At 1304, a dielectric waveguide interface configuration is selected from a group of available options or a new DWG interconnect structure is designed. Usually, the core size and shape, cladding thickness, and dielectric constants of the core and cladding will determine a characteristic impedance of the DWG.

An interposer is inserted between the transceiver IC and the DWG interconnect structure and provides two reference planes that may be optimized for respective interfaces. At 1306, an impedance of an interface waveguide contained in a first interface region of the interposer is matched to an impedance of the antenna. This may be done by selecting a size and configuration and material for use in the interposer and the interface waveguide region. For example, to match the 120-140 GHz band of operation selected for the transceiver IC, an EIA standard WR-6 configuration waveguide region may be fabricated. The waveguide may be open (air) or filled with a dielectric. An open waveguide region may be coated with a conductive coating to make a metal waveguide.

At 1308, a characteristic impedance of the interface waveguide at a second interface region of the interposer is matched to a characteristic impedance of the dielectric waveguide. This may be done be tapering the end of the waveguide region, as illustrated in FIG. 1, for example.

At 1310, the first interface region is coupled to the second interface region with an interface waveguide within the interposer In this manner, an interposer that acts as a buffer zone is used to establish two well-defined reference planes that can be optimized independently. A first plane is located between the radiating elements and the interposer and a second plane is a surface between the interposer and the DWG interconnect. The interposer allows for the introduction of features that improve the isolation between transmitter and receiver antennas in the device, relax the alignment tolerances, and enhance the impedance matching between the antennas and the dielectric waveguide.

In described examples, a transceiver implemented in a BGA package was described. Other examples may use other known or later developed integrated circuit packaging techniques to provide a transceiver that includes one or more antennas located on a surface of the transceiver.

In described examples, a transceiver having a dimension of 8 mm×6 mm with two antennas operating in the 120-140

GHz band was described. In other examples, different size and shaped transceiver packages may be accommodated by adjusting the size of the interposer accordingly. Operation in different frequency bands may be accommodated by selecting different sized waveguide regions for the interposer.

The thickness and overall shape of the interposer may be selected to provide mechanical and electrical characteristics needed for a selected DWG interconnect structure.

In described examples, copper is used as a conductive layer. In other examples, other types of conductive metals or non-metallic conductors may be used to pattern signal lines and antenna structures, for example.

In this description, the term "couple" and derivatives thereof mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Modifications are possible in the described embodiments, and other embodiments are possible, within the scope of the claims.

What is claimed is:

1. An apparatus comprising:

an interposer having opposite first and second surfaces, the interposer including:

an integrated circuit antenna interface region on the first surface;

an external waveguide interface region on the second surface the external waveguide interface region directly opposing the integrated circuit antenna interface region;

internal waveguide coupled between the integrated circuit antenna interface region and the external waveguide interface region; and a support portion on the first surface.

2. The interposer of claim 1, wherein the support portion surrounds the integrated circuit antenna interface region and forms a cavity over the integrated circuit antenna interface region, and the cavity is configured to accommodate an integrated circuit.

3. The apparatus of claim 2, wherein the integrated circuit antenna interface region is configured to interface with an antenna on a packaged integrated circuit in the cavity.

4. The apparatus of claim 3, wherein the internal waveguide is filled with a dielectric material, and the apparatus further comprises the dielectric material coupled between the integrated circuit antenna interface region and the antenna.

5. The apparatus of claim 1, further comprising an integrated circuit having an antenna, in which the support portion supports the first surface over the integrated circuit, and the integrated circuit antenna interface region opposes the antenna.

6. The apparatus of claim 1, further comprising an interface structure over the second surface, the interface structure configured to align an external waveguide with the external waveguide interface region.

7. The apparatus of claim 6, wherein the interface structure is mechanically coupled to the interposer.

8. The apparatus of claim 1, wherein the external waveguide interface region is configured to interface with at least one of: a dielectric waveguide (DWG), a rectangular waveguide, or an external waveguide standardized by Electronic Industries Alliance (EIA) RS-261-B.

9. The apparatus of claim 1, wherein the external waveguide interface region is configured to be mechanically coupled to an external waveguide.

10. An apparatus comprising:

an interposer having opposite first and second surfaces, the interposer including:

an integrated circuit antenna interface region on the fist surface;

an external waveguide interface region on the second surface the external waveguide interface region directly opposing the integrated circuit antenna interface region; and an internal waveguide coupled between the integrated circuit antenna interface region and the external waveguide interface region.

11. The interposer of claim 10, wherein the opening is coated with a conductive material.

12. The interposer of claim 10, wherein the opening is filled with a dielectric material.

13. The apparatus of claim 10, further comprising an integrated circuit having an antenna directly opposing the integrated circuit antenna interface region.

14. An apparatus comprising:

an interposer having opposite first and second surfaces, the interposer including:

an integrated circuit antenna interface region on the first surface;

an external waveguide interface region on the second surface, the external waveguide interface region directly opposing the integrated circuit antenna interface region; and an internal waveguide coupled between the integrated circuit antenna interface region and the external waveguide interface region, the internal waveguide having a circular cross section.

15. The apparatus of claim 14, wherein the external waveguide interface region is configured to interface with at least one of: a dielectric waveguide (DWG), a rectangular waveguide, or an external waveguide standardized by Electronic Industries Alliance (EIA) RS-261-B.

16. The apparatus of claim 14, further comprising an integrated circuit having an antenna, the antenna directly opposing the integrated circuit antenna interface region.

17. An apparatus comprising:

an interposer having opposite first and second surfaces, the interposer including:

a first integrated circuit antenna interface region on the first surface;

a first external waveguide interface region on the second surface, the first external waveguide interface region directly opposing the first integrated circuit antenna interface region;

a first internal waveguide coupled between the first integrated circuit antenna interface region and the external first waveguide interface region;

a second integrated circuit antenna interface region on the first surface;

a second external waveguide interface region on the second surface the second external waveguide interface region directly opposing the second integrated circuit antenna interface region; and a second internal waveguide coupled between the second integrated circuit antenna interface region and the second external waveguide interface region.

18. The apparatus of claim 17, further comprising a material between the first integrated circuit antenna interface region and the second integrated circuit antenna interface region, in which the material is reflective or absorptive to a radio frequency signal.

19. The apparatus of claim 17, further comprising an electronic bandgap structure between the first integrated circuit antenna interface region and the second integrated circuit antenna interface region.

20. The apparatus of claim 7, wherein the first internal waveguide has a first cross section, the second internal waveguide has a second cross section, and the first and second cross sections are perpendicular to each other.

21. The apparatus of claim 7, wherein the first and second external waveguide interface regions are each configured to interface with at least one of: a dielectric waveguide (DWG), a rectangular waveguide, or an external waveguide standardized by Electronic Industries Alliance (EIA) RS-261-B.

22. The apparatus of claim 17, further comprising an integrated circuit having a first antenna and a second antenna, the first antenna directly opposing the first integrated circuit antenna interface region, and the second antenna directly opposing the second integrated circuit antenna interface region.

23. An apparatus comprising:

an interposer having opposite first and second surfaces, the interposer including:

a first integrated circuit antenna interface region on the first surface;

an external waveguide interface region on the second surface;

a second integrated circuit antenna interface region on the first surface; and an internal waveguide having a first end, a second end, and a third end, the first end coupled to the external waveguide interface region, the second end coupled to the first integrated circuit antenna interface region, and the third end coupled to the second integrated circuit antenna interface region.

24. The apparatus of claim 23, further comprising an integrated circuit having a first antenna and a second antenna, the first antenna directly opposing the first integrated circuit antenna interface region, and the second antenna directly opposing the second integrated circuit antenna interface region.

25. The apparatus of claim 23, wherein the external waveguide interface region is configured to interface with at least one of: a dielectric waveguide (DWG), a rectangular waveguide, or an external waveguide standardized by Electronic Industries Alliance (EIA) RS-261-B.

* * * * *